US006748608B1

(12) United States Patent
Fukazawa

(10) Patent No.: US 6,748,608 B1
(45) Date of Patent: Jun. 15, 2004

(54) SWIMMING GOGGLE

(75) Inventor: Shunji Fukazawa, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 10/149,293

(22) PCT Filed: Oct. 13, 2000

(86) PCT No.: PCT/JP00/07138

§ 371 (c)(1),
(2), (4) Date: Jun. 11, 2002

(87) PCT Pub. No.: WO02/32511

PCT Pub. Date: Apr. 25, 2002

(51) Int. Cl.[7] ..... A61F 9/02
(52) U.S. Cl. ..... 2/440; 2/428; 2/436
(58) Field of Search ..... 2/12, 13, 15, 426, 2/428, 434, 439, 440, 441, 442, 443, 445, 446, 450, 452

(56) References Cited

U.S. PATENT DOCUMENTS 4,989,274 A * 2/1991 Patelski, III ..... 2/436
5,459,882 A * 10/1995 Yamamoto ..... 2/428
5,596,771 A * 1/1997 Hsu et al. ..... 2/428
5,687,428 A 11/1997 Yamamoto
6,029,284 A 2/2000 Kawashima et al.
6,070,272 A * 6/2000 Chiang ..... 2/442
6,349,421 B2 * 2/2002 Fukasawa et al. ..... 2/428
6,446,272 B1 * 9/2002 Lee ..... 2/428

FOREIGN PATENT DOCUMENTS

JP 10-57522 3/1998
JP 2001-37911 * 7/1999
JP 3072783 8/2000
JP 2002-238941 * 2/2001 ..... A61F/9/02

OTHER PUBLICATIONS

JP 2001–37911, Fukazawa, translated abstract.*

* cited by examiner

*Primary Examiner*—Gary L. Welch
(74) *Attorney, Agent, or Firm*—Clark & Brody

(57) ABSTRACT

Here is disclosed swimming goggles 1 comprising a pair of lenses 2, frames 3 mounted around these lenses 2, respectively, and pairs of upper and lower arms 13, 14 extending from the respective frames 3 wherein each of these pairs of arms 13, 14 are connected to each other by means of a connecting region to which a buckle 4 is attached.

6 Claims, 6 Drawing Sheets

SWIMMING GOGGLE

TECHNICAL FIELD

This invention relates to swimming goggles.

BACKGROUND ART

The swimming goggles of well known art disclosed in Japanese Patent Application No. 1999-104267A comprise a pair of lens members made of polycarbonate resin and a pair of arms respectively extending rearward from upper and lower parts of the respective lens members. The upper and lower arms get nearer to each other until these two arms are interconnected together at rear ends thereof. The swimming goggles further include a head band which is relatively a narrow elastic band and guided through insertion holes defined between the upper and lower arms at rear ends thereof.

In the swimming goggles disclosed in the above-cited Application, the upper and lower arms intend to distribute the tensile force of the head band exerted upon the goggles as widely as possible and thereby to press an entire face covering pad of the goggles against the wearer's face as uniformly as possible. However, the arms and the lenses are integrally molded from a highly rigid synthetic resin and therefore a shock exerted upon the arms when the swimmer dives into water may be immediately transmitted to the lenses. Consequently, the lenses may sometimes be shifted from proper positions thereof. In addition, a force exerted upon one of the upper and lower arms may be readily transmitted to the other, resulting in that the upper and lower arms cooperate to cause such shift of the position of the lenses. Furthermore, the head band intensely pulls the arms rearward and this pulling force may immediately affect the lenses to shift the lenses rearward.

It is an object of this invention to provide novel swimming goggles adapted to solve the problem of the above-cited conventional swimming goggles due to the presence of the arms highly rigid.

SUMMARY OF THE INVENTION

According to this invention, there is provided swimming goggles basically comprising a pair of lenses, frames mounted on peripheral edge regions of the respective lenses, respectively, and connected to each other in the vicinity of inner ends of the respective lenses and head band attached to the respective frames in the vicinity of outer ends of the respective lenses by means of buckles.

Furthermore, the lenses are molded from a hard material while the frames are molded from a flexible and elastic material, each of these frames includes a pair of upper and lower arms molded from the flexible and elastic material and extending rearward of the goggles from positions on upper and lower edges of the frame, respectively, and the pair of arms are connected to each other at rear ends thereof in a connecting region extending in a vertical direction and each of the buckles is attached to this connecting region.

This invention further includes preferred embodiments as follows:

The buckles are molded from a material harder than that of the frames.

The buckles are detachably engaged with the respective connecting regions from the front of the swimming goggles.

The buckles are engaged with the respective connecting regions under elastic deformation of the arms or the connecting regions.

The pair of arms act upon the vicinity of the positions as the pair of arms are pulled rearward so that the vicinity of the positions are pressed tightly against associated one of the lenses.

The connecting regions are molded from the flexible and elastic material.

PREFERRED EMBODIMENTS OF THE INVENTION

Details of swimming goggles will be more fully understood from the description given hereunder in reference to the accompanying drawings.

Figure 1:
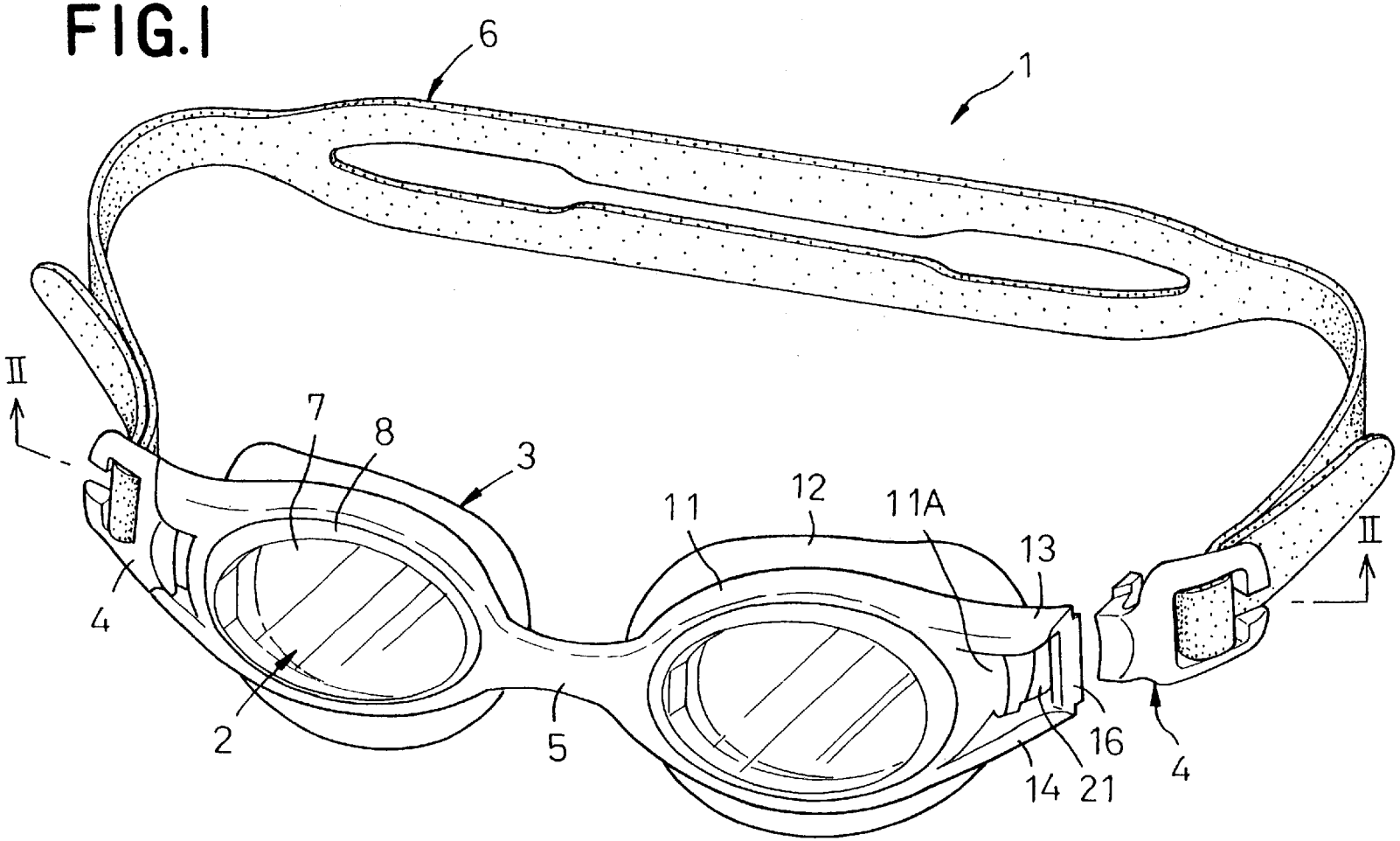
FIG. 1 is a perspective view of the swimming goggles according to this invention.

Swimming goggles 1 shown in FIG. 1 in a perspective view comprise a pair of lenses 2, frames 3 associated with the respective lenses 2, and head band 6 length-adjustably connected to the respective frames 3 by means of buckles 4 wherein the right and left frames 3 are connected integrally with each other by means of a middle connector bridge 5. It should be understood that one of the buckles 4 is illustrated in FIG. 1 to be disconnected from the left frame 3.

The lenses 2 are molded from a hard resin such as polycarbonate and respectively have lens bodies 7 defining front sides of the lenses 2 and peripheral walls 8 extending along respective peripheral edges of the respective lens bodies 7.

The frames 3 are molded from a flexible and elastic resin such as plastic elastomer and respectively have annular regions 11 defining front parts of the respective frames 3 and destined to be engaged with the peripheral walls 8 of the respective lenses 2 from the outer side, and face covering pads 12 defining rear parts of the respective frames 3 and destined to be tightly placed against the wearer's face. Upper and lower arms 13, 14 extend rearward of the goggles 1 from positions on the upper and lower edges of the respective lenses 2 and respective pairs of upper and lower arms 13, 14 are connected to each other at rear end regions thereof by means of connecting regions 16 extending in vertical direction.

Figure 2:
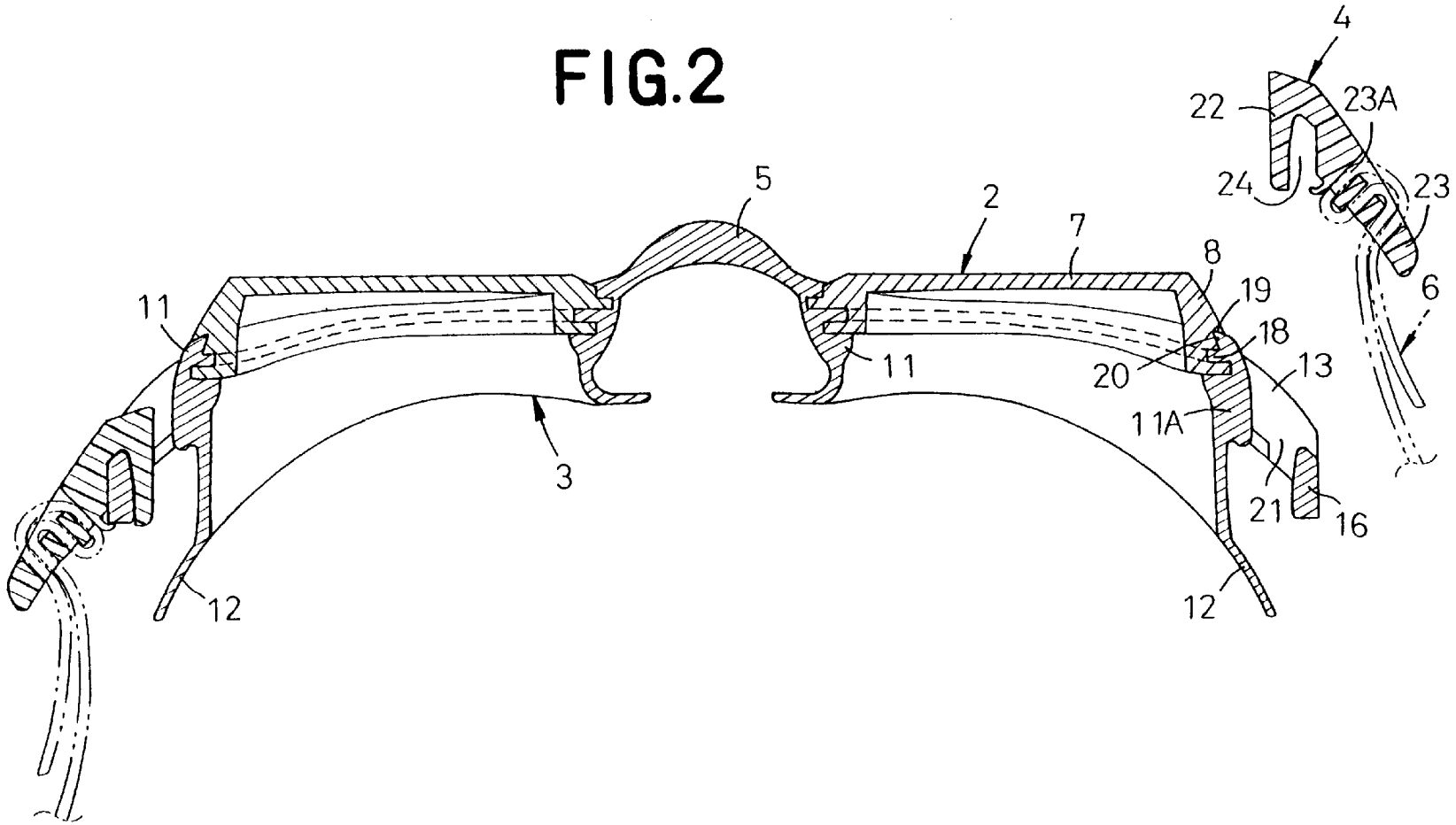
FIG. 2 is a sectional view taken along a line II—II in FIG. 1.

FIG. 2 is a sectional view taken along a line II—II in FIG. 1. As shown, the lenses 2 are formed along rear zones of the respective peripheral walls with grooves 18 circumferentially extending along the peripheral walls 8. The annular regions 11 of the respective frames 3 are engaged with these grooves 18 to integrate the lenses 2 with the frames 3. The outer end regions of the respective lenses 2 lying adjacent to the respective buckles 4 are formed immediately above the grooves 18 with step-like recesses 19 so that front edges 20 of the frames 3 may be engaged with these step-like recesses 19 from behind (i.e., from below as viewed in FIG. 2).

The frames 3 are formed integrally with the middle connector bridge 5, the annular regions 11, the pads 12 and the upper and lower arms 13, 14 wherein through-holes 21 are defined between the outer end regions 11A of the respective annular regions 11 and the connecting region 16 extending in a vertical direction between the rear end regions of the respective arms 13, 14 (See FIG. 1 also).

The buckles 4 are made of a resin harder than that of the frames 3 and have correspondingly a high rigidity. The buckles 4 respectively have hook-like regions 22, and band guide regions 23 with gaps 24 defined between the regions 22, 23. Each of the band guide regions 23 is formed with two or more insertion holes 23A through which the head band 6 is guided as shown. Each of the hook regions 22 is inserted into one of the through-holes 21 from the front side of the frame 3 and thereby each of the gaps 24 is engaged with one of the connecting regions 16 of the frame 3 to attach the head band 6 to the frame 3. If desired, the gap may be dimensioned to be slightly larger than the thickness of the connecting regions 16 to ensure that the arms 13, 14 and the connecting regions 16 can be attached to the frame 3 by elastically deforming these arms 13, 14 and connecting regions 16. Such manner of attachment enables the buckles 4 to be easily attached to or detached from the frame 3 and alleviates an anxiety that the buckles 4 might be unintentionally detached from the frame 3.

Figure 3:
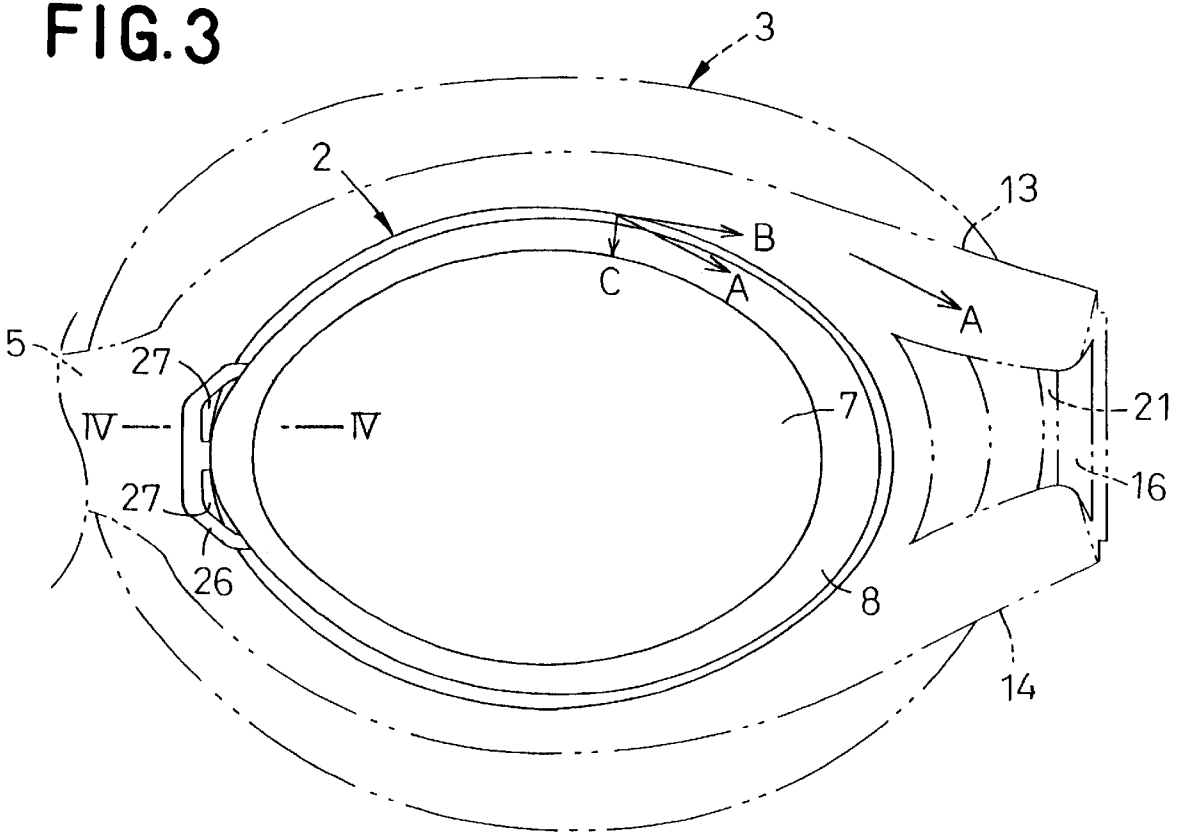
FIG. 3 is a plan view of a lens.

FIG. 3 is a plan view of the lens 2 with the frame 3 indicated by imaginary lines. The lens 2 includes a projection 26 laterally extending from the peripheral wall 8 at its inner end which is contiguous to the middle connector bridge 5 and this projection 26 is provide with two through-holes 27.

Figure 4:
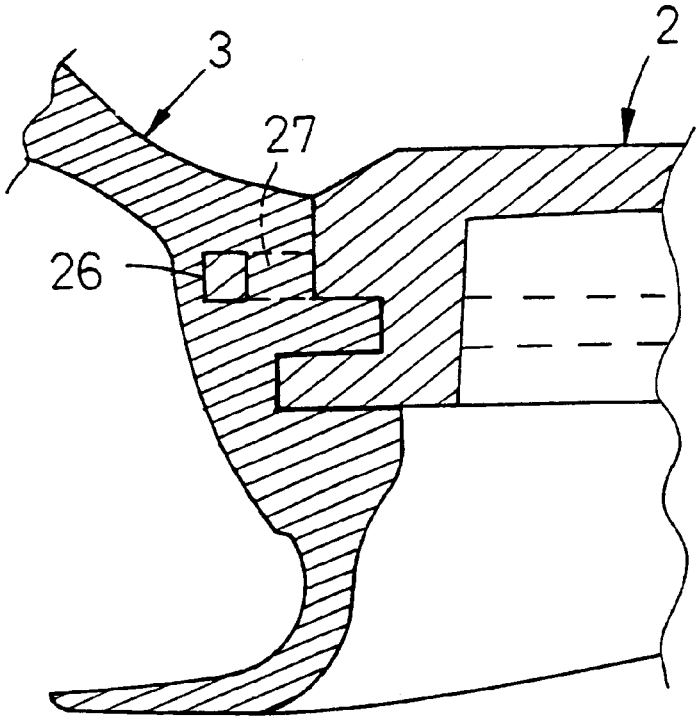
FIG. 4 is a fragmentary sectional view taken along a line IV—IV in FIG. 3.

FIG. 4 is a fragmentary cross-sectional view taken along a line IV—IV in FIG. 3. In FIG. 4, the frame 3 is indicated by solid lines. As will be apparent from FIG. 4, the through-hole 27 of the lens 2 is filled with resin forming the frame 3, i.e., the lens 2 and the frame 3 are integrated with each other to avoid an apprehension that the lens 2 might be unintentionally disengaged from the frame 3. In such manner by which the lens 2 and the frame 3 are combined, no gap is formed between the lens 2 and the frame 3 which allows flood to occur through the gap even when the pair of lenses 2 are strongly pulled to such direction as to separate the pair of lenses 2 each other.

Referring again to FIG. 3, assumed that a tensile force A of the head band 6 is exerted on the upper arms 13, this tensile force A is divided into a force B tangentially oriented with respect to the peripheral walls 8 of the respective lenses and a force C oriented to press the frames 3 tightly against the peripheral walls 8. The force C functions to retain the lenses 2 and the frames 3 in flood-proof engagement with each other.

Figure 5:
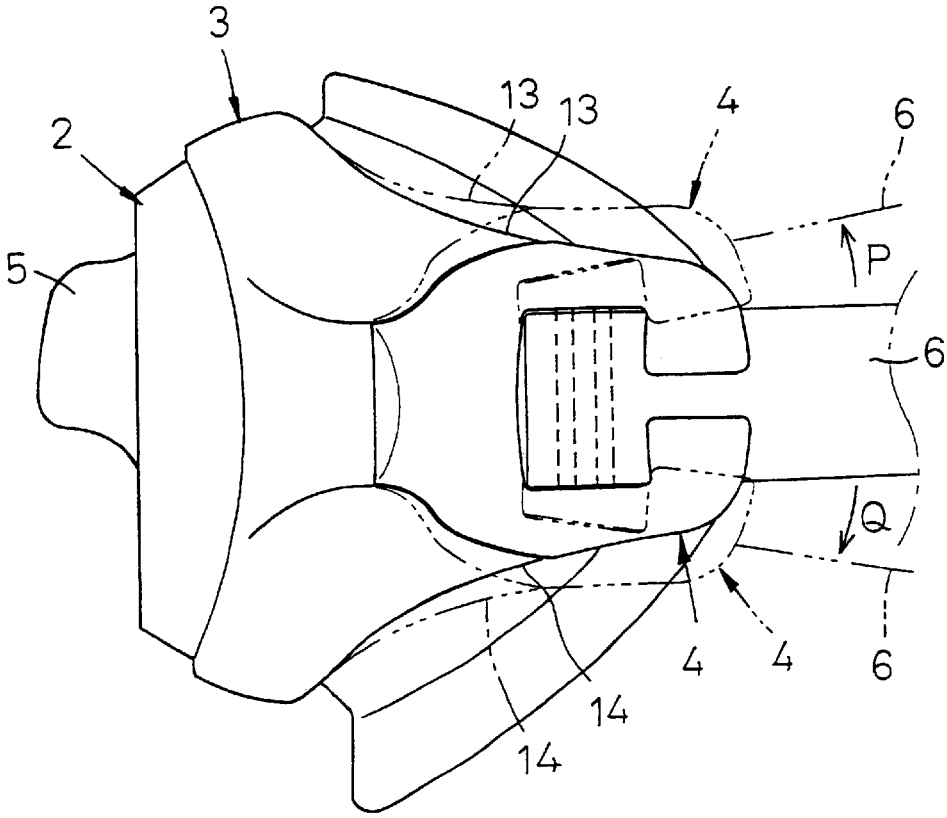
FIG. 5 is a fragmentary side view of the swimming goggles according to this invention.

FIG. 5 is a fragmentary side view showing major parts of the goggles 1 with the buckles 4 attached to the associated frame 3. It is assumed that the force is exerted on the head band 6 so as to shift the head band 6 up and downward as viewed in FIG. 5, i.e., in directions indicated by arrows P and Q, respectively, for example, as the wearer of the goggles 1 dives into water. The upper and lower arms 13, 14 made of a flexible elastic material effectively absorb a possible shift of the head band 6 which would otherwise be transmitted to the face covering pads 12 and the lenses 2. In this way, these arms 13, 14 reliably prevent the positions of the respective lenses 2 relative to the wearer' face from being shifted.

Figure 6:
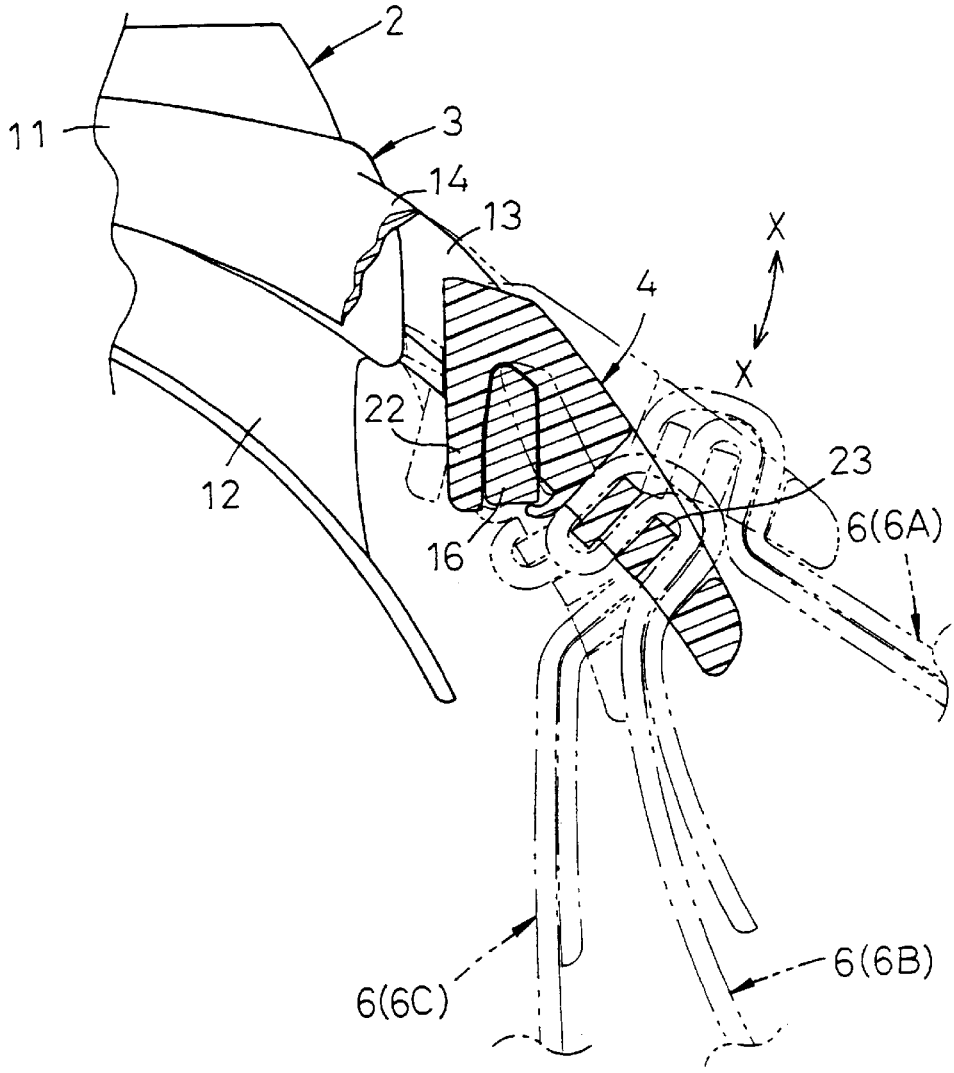
FIG. 6 is a fragmentary perspective view of the outer end region of the frame as partially cutaway.

FIG. 6 is a fragmentary perspective view of the outer end region of the frame as partially cutaway. Depending on the head size of the individual goggle wearer, the head band 6 may extend in various directions such as 6A, 6B, 6C as indicated by imaginary lines. Correspondingly, the upper and lower arms 13, 14 are moved in a direction indicated by double-head arrow X—X and thereby prevent or limit the movement of the head band 6 from being transmitted to the face covering pads 12. In this way, the face covering pads 12 are retained to be tightly pressed against the wearer's face. The buckles 4 also are moved together with the head band 6 and the arms 13, 14 in the direction X—X and therefore it is not apprehended that the head band 6 guided and fixed in folded state by the respective buckles 4 might be slackened regardless of the direction in which the head band 6 extends.

With the swimming goggles according to this invention, the positions of the respective lenses relative to the wearer's face are always stabilized since the arms made of a flexible and elastic material and extending rearward from the respective frames well absorb various movements of the head band.

What is claimed is:

1. Swimming goggles comprising:

a pair of lenses;

frames mounted on peripheral edge regions of respective said lenses, respectively, and connected to each other in a vicinity of inner ends of respective said lenses and head band attached to respective said frames in a vicinity of outer ends of respective said lenses by means of buckles;

said lenses being molded from a hard material while said frames are molded from a flexible and elastic material;

each of said frames including a pair of upper and lower arms molded from said flexible and elastic material and extending rearward of said goggles from positions on upper and lower edges of said frame, respectively; and said pair of arms being connected to each other at rear ends thereof in a connecting region extending in a vertical direction and each of said buckles being attached to this connecting region.

2. The swimming goggles according to claim 1, wherein said buckles are molded from a material harder than that of said frames.

3. The swimming goggles according to claim 1, wherein said buckles are detachably engaged with said connecting regions from the front of said swimming goggles.

4. The swimming goggles according to claim 3, wherein said buckles are engaged with said connecting regions under elastic deformation of said arms or said connecting regions.

5. The swimming goggles according to claim 1, wherein said pair of arms act upon the vicinity of said positions as said pair of arms are pulled rearward so that said vicinity of said positions are pressed tightly against associated one of said lenses.

6. The swimming goggles according to claim 1, wherein said connecting regions are molded from said flexible and elastic material.

* * * * *